US008141958B2

(12) United States Patent
Strahler

(10) Patent No.: US 8,141,958 B2
(45) Date of Patent: Mar. 27, 2012

(54) DEVICE FOR HOLDING THE HEAD OF A TOOTHBRUSH

(75) Inventor: Reto Strahler, Adligenswil (CH)

(73) Assignee: Trisa Holding AG, Triengen (CH)

( * ) Notice: Subject to any disclaimer, the term of this patent is extended or adjusted under 35 U.S.C. 154(b) by 1061 days.

(21) Appl. No.: 10/590,444

(22) PCT Filed: Dec. 8, 2004

(86) PCT No.: PCT/CH2004/000724

§ 371 (c)(1),
(2), (4) Date: Apr. 9, 2007

(87) PCT Pub. No.: WO2005/089592

PCT Pub. Date: Sep. 29, 2005

(65) Prior Publication Data

US 2007/0241606 A1 Oct. 18, 2007

(30) Foreign Application Priority Data

Mar. 24, 2004 (CH) ..... 496/04

(51) Int. Cl.
*B25B 1/20* (2006.01)

(52) U.S. Cl. ..... 300/10; 300/2; 300/11

(58) Field of Classification Search ..... 300/1, 2, 300/10, 11, 17, 19, 21; 15/167.1
See application file for complete search history.

(56) References Cited

U.S. PATENT DOCUMENTS

| | | | |
|---|---|---|---|
| 5,269,038 | A | 12/1993 | Bradley |
| 5,799,354 | A | 9/1998 | Amir |
| 5,863,102 | A | 1/1999 | Waguespack et al. |

FOREIGN PATENT DOCUMENTS

| | | | |
|---|---|---|---|
| DE | 197 20 024 | A1 | 11/1998 |
| DE | 298 22 826 | U1 | 5/1999 |
| DE | 201 09 123 | U1 | 11/2002 |
| EP | 0 563 419 | A1 | 10/1993 |
| WO | WO 98/58563 | | 12/1998 |

*Primary Examiner* — Shay Karls
(74) *Attorney, Agent, or Firm* — Oliff & Berridge, PLC

(57) ABSTRACT

The device for fixedly holding the head of a toothbrush in a processing machine comprises holding parts with a support surface that is formed on a holding flange. The holding flange is inserted between the bristle carrier and the holding plate of the head of the toothbrush and supports the bristle carrier with the support surface thereof.

16 Claims, 3 Drawing Sheets

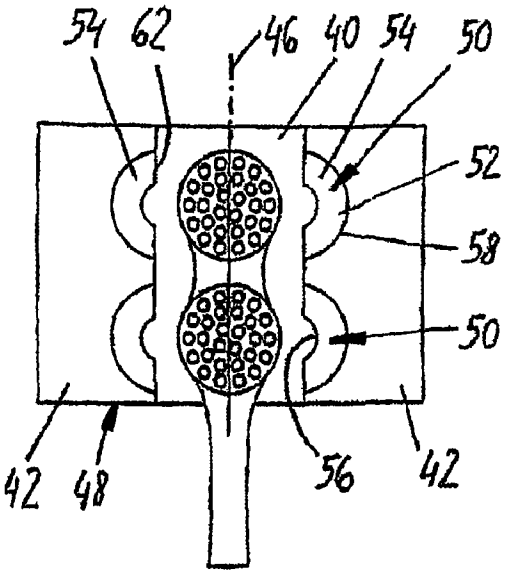
Fig. 5
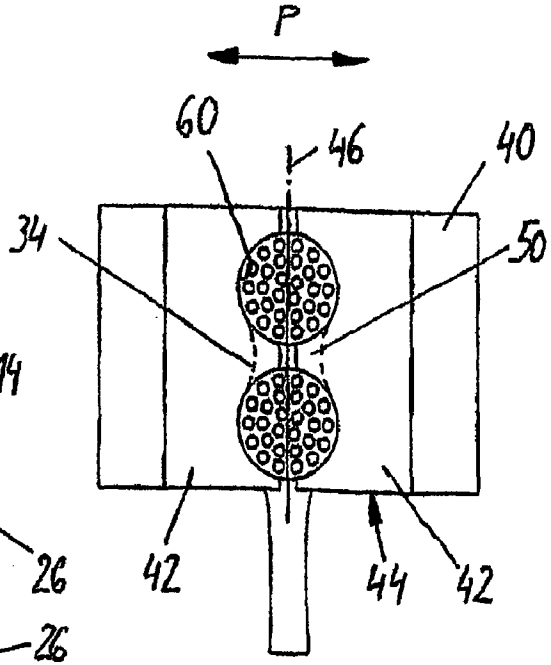
Fig. 4
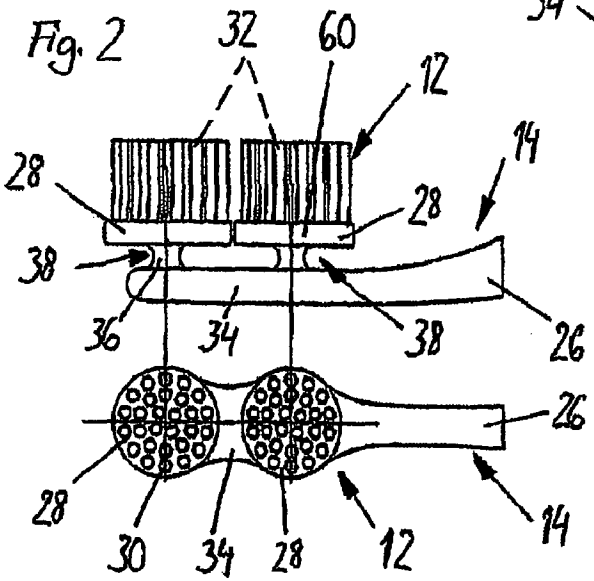
Fig. 2
Fig. 3

DEVICE FOR HOLDING THE HEAD OF A TOOTHBRUSH

The present invention relates to a device for securing the head of a toothbrush in a processing machine.

Conventional toothbrushes comprise a toothbrush head, a toothbrush neck, which adjoins the head, and a toothbrush handle, which adjoins the neck. The part which gives the structure of the toothbrush head, and in particular the part which receives the bristles, is usually produced from a rigid plastic, for example polypropylene. The toothbrush head may also have a flexible plastic material. In the case of a known, conventional tufting method, bristle clusters curved in a u-shaped manner are anchored, by means of metal plates, in holes in that part of the brush head which consists of rigid plastic. During this tufting process, the toothbrush heads are secured by means of retaining devices. As is known, for example, from WO-A-98/58563, these retaining devices may have a retaining plate, which interacts with the free end of the toothbrush head, and two clamps, which act in the region of transition between the toothbrush neck and the toothbrush head and can be moved from a receiving position into a clamping position. These clamps may be formed in a concave manner in order to enclose the toothbrush head from the side. The front side of the toothbrush head with the holes for receiving the bristle clusters remains free, while the rear side of the toothbrush head is supported, in order to counteract the forces which occur during the tufting operation.

Reliable, secure retention of the toothbrushes on the toothbrush head and precise positioning are particularly important, in particular, in the tufting machine in order that the tufting tool can readily come into contact with the molded holes in the toothbrush head. Following the tufting process, the bristles are usually cut to the desired length and then ground in order to round off the ends. Since it is also possible for the toothbrush head to be subjected to considerable forces during these finishing processes, in particular during the cutting process, it is also usually the case here that retaining devices are used to secure the toothbrushes and transport them both in the tufting machine and, during finishing, from processing station to processing station.

The known retaining devices can be used successfully for most toothbrushes. However, the task of securing toothbrushes with specially designed toothbrush heads may be problematic. Toothbrushes or toothbrush heads of this type are known, for example, from DE-U-29822826, DE-U-20109123, U.S. Pat. Nos. 5,269,038 and 5,799,354. All these toothbrushes have in common the fact that they have a plate-like bristle carrier and a retaining crosspiece made of a rigid, structure-giving plastic. The retaining crosspiece merges into the toothbrush neck in each case, and a recess is present between the retaining crosspiece and the bristle carrier. This recess allows the bristle carrier to move freely in relation to the retaining crosspiece. This flexibility is achieved either by means of a weakening in the rigid plastic, for example in the form of a film hinge, or by means of a thin material bridge or a hinge made of flexible elastomeric plastic.

It is an object of the present invention to provide a retaining device which straightforwardly ensures secure retention of the toothbrush head while, at the same time, providing reliable support for the bristle carrier.

This object is achieved by a device as claimed in claim 1.

The retaining device according to the invention has a retaining part with a retaining flange which engages between the bristle carrier and the retaining crosspiece. A supporting surface of the retaining flange interacts with the bristle carrier, so that, despite its ability to move in relation to the retaining crosspiece, the bristle carrier is then positioned, and retained, in the retaining device such that it can absorb the forces which occur during processing operations such as tufting, cutting and grinding.

Particularly preferred embodiments of the device according to the invention are given in the dependent patent claims.

The invention is explained in more detail with reference to embodiments illustrated in the drawing, in which, purely schematically:

FIG. 2 shows a view of a head and part of the neck of a first embodiment of a toothbrush, the device according to the invention being particularly suitable for retaining this toothbrush;

FIG. 3 shows a plan view of the head and part of the neck of the toothbrush according to FIG. 2;

FIG. 4 shows a plan view of a device according to the invention having two retaining parts located in the retaining position, in which they secure the head of the toothbrush which is shown in FIGS. 2 and 3;

FIG. 5 shows, likewise in plan view, the device which is shown in FIG. 4, the retaining parts being located in the receiving position;

Figure 1:
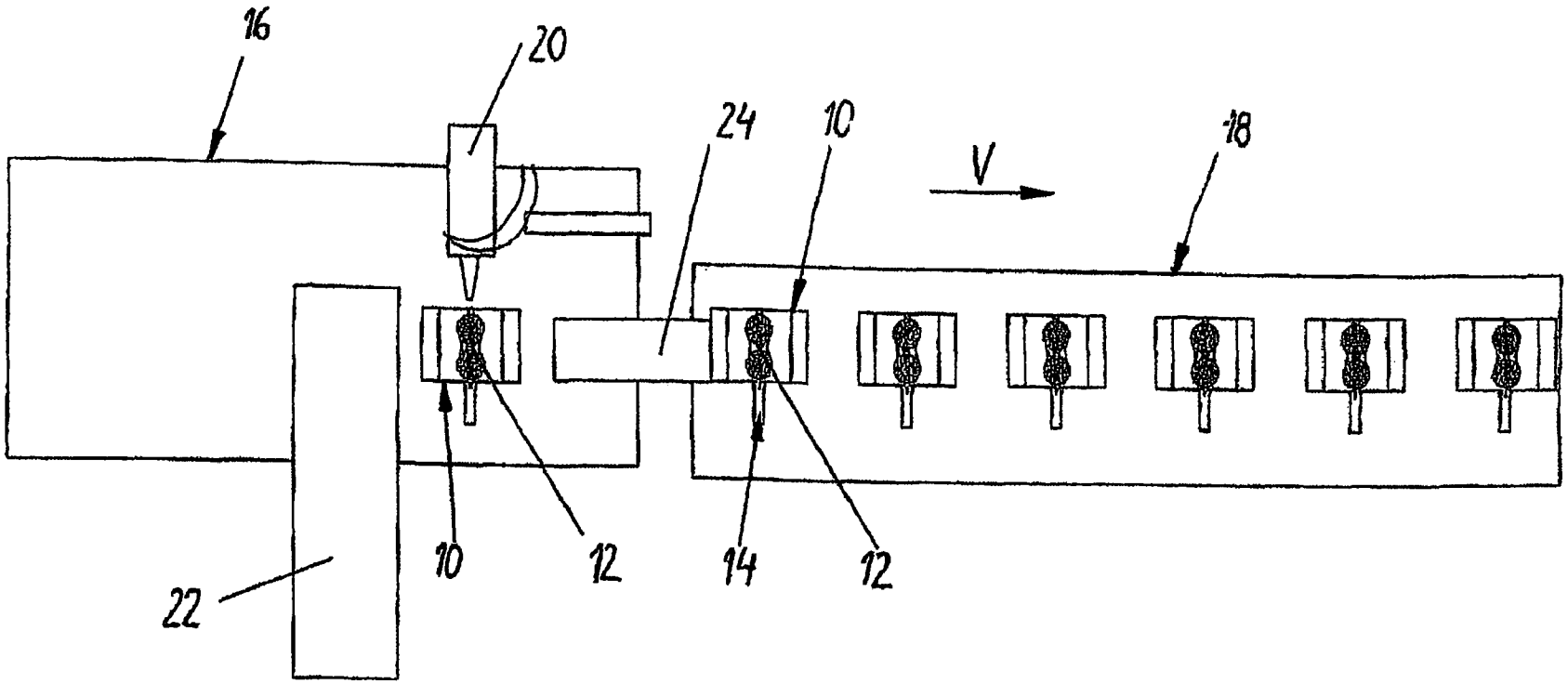
FIG. 1 shows, in vastly simplified form, a plan view of a tufting machine and a finishing machine, the toothbrushes which are to be processed being retained by retaining devices according to the invention.

The device 10 according to the invention for firmly retaining a head 12 of a toothbrush 14 is intended for use in toothbrush-processing machines. In particular in tufting machines 16 and downstream finishing machines 18 having a cutting station for cutting the bristles to the desired length, having a grinding station for rounding off the free ends of the trimmed bristles, and possibly having further workstations, the toothbrush heads 12 may be subjected to considerable forces, for which reason the retaining device 10 according to the invention is suitable in particular, but not exclusively, for use in such machines.

The tufting machine 16 of known design has a tufting unit 20, by means of which bristle clusters are inserted into the toothbrush head 12. During this operation, the toothbrush head 12 is retained by means of a retaining device 10 according to the invention. 22 designates a similarly known feed device by means of which toothbrush bodies which are not covered with bristles are fed to the tufting machine 16, these toothbrush bodies being introduced individually into the retaining device 10 by means of a handling arrangement. A further handling arrangement (not shown) removes the respective toothbrush 14 from the retaining device 10, following the tufting operation, and transfers it to a conveyor 24 in order to be transported further to the finishing machine 18. In the latter, the bristle-covered toothbrushes 14 are inserted, likewise by means of a handling apparatus, into a respective retaining device 10, the retaining devices being moved in a stepwise manner in the advancement direction V in order for the toothbrushes 14 which are retained by the retaining devices 10 to be moved from one processing station to the next.

One embodiment of the toothbrush 14 for which the retaining device 10 according to the invention is particularly suitable is disclosed in DE-U-29822826. The toothbrush head 12 and part of a toothbrush neck 26, which adjoins the head, are represented in FIGS. 2 and 3. The toothbrush head 12 has two circular, plate-like bristle carriers 28 which, on their top side, are provided with receiving holes 30 in which bristle clusters 32 can be anchored. Furthermore, the toothbrush head 12 has a retaining crosspiece 34 which merges into the toothbrush neck 26 downstream of the bristle carriers 28, as seen in the longitudinal direction of the toothbrush 14. The bristle carriers 28 are spaced apart from the retaining crosspiece 34 and are arranged parallel thereto, the carriers being fastened on the retaining crosspiece 34 by means of a centrally arranged material bridge 36. Since the cross section of the material bridge 36 is considerably smaller than the diameter of the bristle carriers 28 and the width of the retaining crosspiece 34, an annular free space or an annular recess 38 is present in each case between the retaining crosspiece 34 and the bristle carriers 28. The bristle carriers 28, material bridges 36 and the retaining crosspiece 34, together with the toothbrush neck 26, are produced integrally from rigid plastic, for example polypropylene PP.

FIGS. 4 and 5 show a retaining device 10 according to the invention for toothbrush heads 12 according to FIGS. 2 and 3.

The retaining device 10 has a base plate 40 on which two retaining parts 42 are mounted such that they can be moved, in the manner of a clamping chuck, in and counter to the direction of the double arrow P. In FIG. 4, the retaining parts 42 are located in the retaining position 44. From this position, they can be displaced, symmetrically in relation to a longitudinal center plane 46, in the direction of the double arrow P and thus, at right angles to the longitudinal center plane 46, into the receiving position 48, which is shown in FIG. 5. In the receiving position 48, the two retaining parts 42 are spaced apart from one another to the extent where they incorporate the toothbrush head 12 with play between them.

The retaining parts 42 are defined in a mirror-symmetrical manner in relation to the longitudinal center plane 46. They are of cuboidal basic shape and have receiving recesses 50, which are coordinated with the toothbrush head 12, formed in them. As seen from above, these receiving recesses 50 each have two depressions 52 in the form of ring segments, the base surface of these depressions 52 forming a supporting surface 54 for the bristle carriers 28. The radially inner end of these depressions 52 is bounded by a through-passage recess 56 for the material bridges 36. Following this through-passage recess 56, the receiving recesses 50 are formed to mate with the retaining crosspiece 34 of the toothbrush head 12, as is indicated in FIG. 4 by way of the dashed outlines of the crosspiece 34.

The depression 52 is bounded on the outside in the radial direction by a clamping surface 58 in the form of a segment of a lateral surface of a circular cylinder. These clamping surfaces 58 interact, in the retaining position 44, with the peripheral lateral surface 60 of the bristle carriers 28. The receiving recesses 50 thus bound a retaining flange 62 by way of which the retaining parts 42, in the retaining position 44, engage in the recesses 38 between the bristle carriers 28 and the retaining crosspiece 34. At the same time, the supporting surfaces 54, which are integrally formed on the retaining flanges 64, provide surface-area support for the bristle carriers 28 on their bottom side, which is directed away from the receiving holes 30.

As can be gathered from FIG. 4 in particular, the retaining parts 42 are spaced apart from one another in the retaining position 44. This ensures that the clamping surfaces 58 butt against the lateral surfaces 60 and can clamp the bristle carriers 28 firmly.

On their bottom side, which is directed away from the supporting surface 54, the retaining flanges 62 have further supporting surfaces 54', which are positioned against the retaining crosspiece when the retaining device 10 is closed. By means of the retaining device 10 shown, the toothbrush 14 is thus securely retained, and precisely positioned, by way of its toothbrush head 12. Since the bristle carriers 28 are supported directly, despite their flexible connection in relation to the retaining crosspiece, they can readily be subjected to the considerable forces during the tufting and finishing operations.

Purely for the sake of completeness, it should be mentioned that, as can be seen from FIG. 5, with retaining parts 42 located in the receiving position 48, a toothbrush body is moved into the position shown by means of a handling apparatus. The retaining parts 42 are then moved into the retaining position 44, whereupon the handling apparatus releases the toothbrush body. The same steps are carried out in reverse order in order for the toothbrush 14 to be released.

If desired, it is possible for the recesses 38 to be filled by means of a flexible plastic material, for example TPE, following the bristle-covering operation, as is disclosed in DE-U-29822826.

FIGS. 6-9 show the head 12 and the neck 26 of a toothbrush 14 of a similar embodiment, as is known from DE-U-20109123. This toothbrush has two more or less rectangular, plate-like bristle carriers 28 which are arranged one behind the other, as seen in the longitudinal direction of the toothbrush 14. Located at the free end of the toothbrush head 12 is a brush-head segment 64 which, like the bristle carriers 28, is provided with receiving holes 30 in which bristle clusters 32 can be fastened. Between the brush-head segment 64 and the toothbrush neck 26, a retaining crosspiece 34 is spaced apart from the bristle carriers 28. A further toothbrush-head segment 66 with receiving holes 30 for bristle clusters 32 is located on the toothbrush-neck side of the bristle carriers 28. This further toothbrush-head segment 66, the toothbrush neck 26, the retaining crosspiece 34 and the brush-head segment 64 are produced integrally from a rigid plastic by means of injection molding. The two bristle carriers 28 likewise consist of a rigid plastic; they are connected to one another and to the brush-head segment 64 and/or further brush-head segment 66 by means of a flexible plastic material. These flexible plastic-material bridges, which run at right angles to the longitudinal direction, are designated 68 in FIGS. 6-8.

Figures 6, 7, 8, 9, 10, 11:
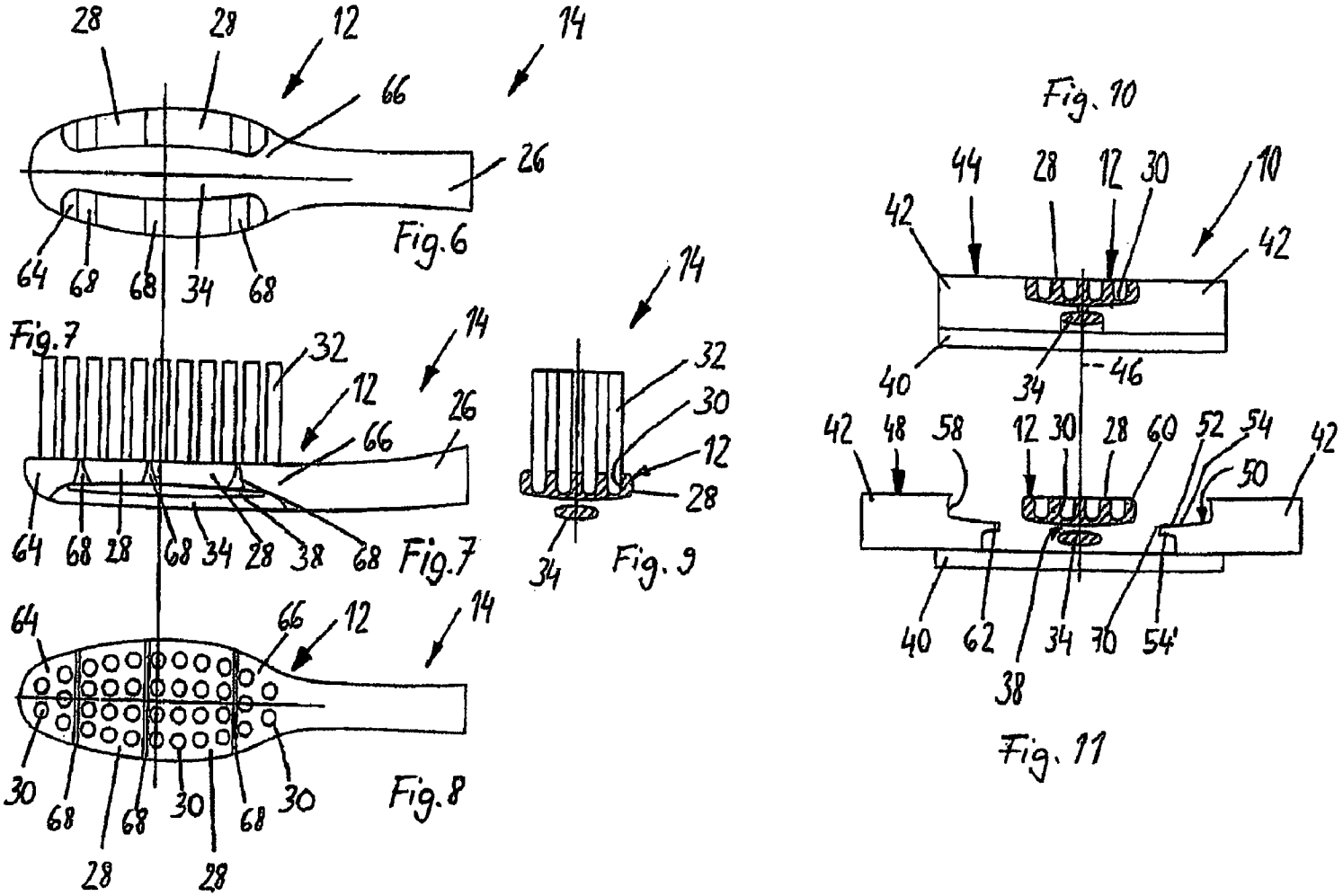
FIG. 6 shows a bottom view of the head and neck of a further embodiment of a toothbrush with two bristle carriers and a retaining crosspiece.
FIG. 7 shows a view of the head and neck of the toothbrush according to FIG. 6.
FIG. 8 shows a plan view of the head and neck of the toothbrush according to FIGS. 6 and 7.
FIG. 9 shows a cross section through the toothbrush head which is shown in FIGS. 6, 7 and 8.
FIG. 10 shows a side view of a device with two retaining parts which are located in the retaining position and secure a toothbrush head according to FIGS. 6-9, the toothbrush head not yet being covered with bristles.
FIG. 11 shows the device which is shown in FIG. 6, with the retaining parts located in a receiving position and the toothbrush head not yet covered with bristles.

The retaining device 10 for receiving and securing the toothbrush head 12 according to FIGS. 6-9, this retaining device being shown in FIGS. 10 and 11, is of basically the same construction as the retaining device 10 according to FIGS. 4 and 5. It likewise has a base plate 40 on which two retaining parts 42, which are formed in a mirror-symmetrical manner in relation to the longitudinal center plane 46, are mounted such that they can be displaced at right angles to the longitudinal center plane 46. FIG. 10 shows the retaining parts 42 in the retaining position 44, and FIG. 11 shows them in the receiving position 48. In contrast to the retaining device 10 according to FIGS. 4 and 5, however, in this case the receiving recesses 50 are formed to mate with the toothbrush head 12 which is shown in FIGS. 6-9. The essentially cuboidal retaining parts 42 have a depression 52 which approximately resembles an oval segment and corresponds to the lateral outer contour of the toothbrush head 12. The depression is bounded at the bottom by a supporting surface 54 which is intended to engage beneath the two bristle carriers 28, and provide them with surface-area support, when the retaining device 10 is closed. The depression 52 is bounded along the periphery by a clamping surface 58. This is formed in a concave manner, as seen in cross section, in order to enclose the bristle carriers 28 from the side in the retaining position 44 of the retaining parts 42.

The supporting surfaces 54, in turn, are integrally formed, in part, on a retaining flange 62, a further supporting surface 54' for the retaining crosspiece 34 being integrally formed on this retaining flange, on the side which is directed away from the supporting surface 54.

As seen in the longitudinal direction, the retaining flange 62 extends over a region which is somewhat shorter than the recess 38 between the retaining crosspiece 34 and the bristle carriers 28. On the side which is directed toward the longitudinal center plane 46, the retaining flanges 62 are bounded by an end side 70 running parallel to the longitudinal center plane 46. In the retaining position 44 of the retaining parts 42, these end sides 70 are spaced apart from one another by a small distance. This, in turn, ensures that the clamping surfaces 58 butt against the lateral surfaces 60 of the bristle carriers 28 in order to clamp the latter firmly.

Following the retaining flanges 62 on both sides, as seen in the longitudinal direction, the receiving recesses 50 are formed to mate with the brush-head segment 64 and further brush-head segment 66, so that, in the retaining position 44, the entire toothbrush head 12 is securely retained by the retaining parts 42 and even the bristle carriers 28, which are only fastened by means of a flexible plastic material, can readily be subjected to the stressing which occurs in a tufting machine or the like.

The material thickness of the retaining flanges 62 at the end side 70—FIGS. 10 and 11—and at the through-passage recess 56—FIGS. 4 and 5—is preferably at least 1 mm. This material thickness increases continuously in the direction away from the longitudinal center plane 46. Furthermore, the supporting surfaces 54 and the further supporting surfaces 54' run at acute, but oppositely directed angles in each case in relation to a plane parallel to the base plate 40, so that a centering action is achieved when the retaining device 10 is closed. Between the retaining parts 42, the base plate 40 is preferably formed such that the toothbrush head 12 or the retaining crosspiece 34 is supported in the retaining device 10.

In the case of a toothbrush which has a recess which extends between the bristle carrier and retaining crosspiece and is open at the free end of the toothbrush head, as seen in the longitudinal direction of the toothbrush—a toothbrush of this type is disclosed, for example, in U.S. Pat. No. 5,799,354—it is possible to provide a retaining part, for supporting the bristle carrier, which moves into this recess in the longitudinal direction of the toothbrush. It is also conceivable, in the case of this embodiment, for the retaining part to be arranged in a stationary manner in the retaining device and for the toothbrush to be pushed on to the retaining flange as it is introduced into the retaining device.

Furthermore, it is conceivable to secure the toothbrush head in a known manner in the retaining device and to support the bristle carrier, in addition, by means of a retaining part. The retaining part or the retaining parts may, in this case, move into the recess of the toothbrush, for example, from the side.

Measures may also be taken on the toothbrush 12 itself in order further to relieve the toothbrush head of loading in particular during the tufting operation. For example, the diameters of the receiving holes 30 for the bristle clusters 32 may be selected to be smaller than or equal to 1.7 mm. Tests have shown that, with such hole diameters, the action of force to which the bristle carrier 28 is subjected is minimal.

Minimal diameters of the receiving holes 30 allow the receiving holes 30 to be of minimal depth, as a result of which the thickness of the bristle carrier 28 and of the toothbrush head 12 can be kept to a minimal level. The depth of the receiving holes 30 is preferably smaller than or equal to 4 mm.

It is also conceivable for the recesses 38 to be filled, in whole or in part, with a flexible material, for example TPE, prior to the tufting process. In this case, flexible material is displaced by means of the retaining part or the retaining parts in order for the bristle carriers 28 to be supported.

The invention claimed is:

1. A combination toothbrush and device for securing the toothbrush in a tufting machine, the toothbrush including a toothbrush head that has a plate-like bristle carrier produced from a rigid plastic, the toothbrush head including a retaining crosspiece produced from a rigid plastic, the bristle carrier and the retaining crosspiece defining a space therebetween, the device comprising:

a retaining part having a retaining flange and a supporting surface integrally formed on the retaining flange, the retaining flange being configured to engage the toothbrush head in the space between (1) the bristle carrier of the toothbrush head, and (2) the retaining crosspiece of the toothbrush head, the retaining part supporting the bristle carrier by way of the supporting surface.

2. The combination toothbrush and device as claimed in claim 1, wherein the retaining part has a clamping surface that interacts with a peripheral lateral surface of the bristle carrier.

3. The combination toothbrush and device as claimed in claim 2, wherein the clamping surface, when viewed in cross section, is of a concave design to enclose the lateral surface.

4. The combination toothbrush and device as claimed in claim 2, wherein the clamping surface follows the supporting surface and runs transversely to the supporting surface.

5. The combination toothbrush and device as claimed in claim 1, wherein the retaining flange, when viewed in cross section, tapers in a direction of a free end of the retaining flange and has a wall thickness of at least 1 mm.

6. The combination toothbrush and device as claimed in claim 1, wherein, on a side of the retaining flange which is directed away from the supporting surface, the retaining flange has a further supporting surface, which interacts with the retaining crosspiece.

7. The combination toothbrush and device as claimed in claim 6, wherein the supporting surface, the clamping surface and the further supporting surface are formed to mate directly with at least one of the bristle carrier and the retaining crosspiece.

8. The combination toothbrush and device as claimed in claim 1, wherein the retaining part comprises two retaining parts which move relative to one another between a retaining position and a receiving position.

9. The combination toothbrush and device as claimed in claim 8, wherein retaining flanges of the two retaining parts are of mirror-symmetrical design.

10. The combination toothbrush and device as claimed in claim 8, wherein retaining flanges of the two retaining parts are spaced apart from one another in the retaining position.

11. The combination toothbrush and device as claimed in claim 1, the retaining part further comprising:

a clamping surface which interacts with a peripheral lateral surface of the bristle carrier, the retaining flange having, on a side which is directed away from the supporting surface, a further supporting surface which interacts with the retaining crosspiece, wherein the supporting surface, the clamping surface and the further supporting surface are formed to mate with the bristle carrier and the retaining crosspiece, respectively.

12. A method for securing a toothbrush in a tufting machine, the method comprising:

employing a retaining part with a retaining flange, and a supporting surface integrally formed on the retaining flange, to engage a toothbrush head in a space between (1) a plate-like bristle carrier of the toothbrush head, the bristle carrier being produced from a rigid plastic, and (2) a retaining crosspiece of the toothbrush head, the retaining crosspiece being produced from a rigid plastic and being spaced apart from the bristle carrier to form the space, the retaining part supporting the bristle carrier by way of the supporting surface.

13. The method according to claim 12, further comprising moving two retaining parts from a receiving position to a retaining position to engage the toothbrush head; and moving the two retaining parts from the retaining position to the receiving position to release the toothbrush head.

14. A toothbrush processed with a processing machine comprising the device according to claim 1.

15. A toothbrush processed with the method according to claim 12.

16. A toothbrush system comprising:

a toothbrush including a toothbrush head that has a plate-like bristle carrier produced from a rigid plastic, the toothbrush head including a retaining crosspiece produced from a rigid plastic, the bristle carrier and the retaining crosspiece defining a space therebetween; and a tufting machine including a device for securing the toothbrush, the device including:

a retaining part having a retaining flange and a supporting surface integrally formed on the retaining flange, the retaining flange being configured to engage the toothbrush head in the space between (1) the bristle carrier of the toothbrush head, and (2) the retaining crosspiece of the toothbrush head, the retaining part supporting the bristle carrier by way of the supporting surface.

* * * * *